United States Patent [19]

Douglass

[11] Patent Number: 4,994,779

[45] Date of Patent: Feb. 19, 1991

[54] CLASS J TIME DELAY FUSE

[75] Inventor: Robert S. Douglass, Glencoe, Mo.

[73] Assignee: Cooper Industries, Inc., Houston, Tex.

[21] Appl. No.: 396,705

[22] Filed: Aug. 21, 1989

[51] Int. Cl.[5] ..... H01H 85/04

[52] U.S. Cl. ..... 337/163; 337/166; 337/291; 337/295

[58] Field of Search ..... 337/158, 159, 160, 163, 337/165, 166, 290, 295, 291

[56] References Cited

U.S. PATENT DOCUMENTS

| | | | |
|---|---|---|---|
| 1,716,884 | 6/1929 | Goss | 337/295 |
| 2,657,294 | 10/1953 | Laing | 337/164 |
| 3,261,952 | 7/1966 | Kozacka | 337/295 |
| 3,394,333 | 7/1968 | Jacobs, Jr. | 337/291 |
| 4,101,860 | 7/1978 | Fister | 337/159 |
| 4,117,441 | 9/1978 | Wycklendt | 337/295 |
| 4,511,874 | 4/1985 | Rasmussen | 337/159 |

*Primary Examiner*—Steven L. Stephan
*Assistant Examiner*—Milay H. Vyas
*Attorney, Agent, or Firm*—Laff, Whitesel, Conte & Saret

[57] ABSTRACT

A time-delay fuse 10 having a circular fusible element 22 with stress relief section 24. The cylindrical fuse element 22 is connected to a trigger mechanism 30 by solder or other meltable alloy. The trigger section 30 provides overload protection and the circular fusible element provides short circuit protection resulting in a time-delay fuse which can be used in places where there are size restrictions.

13 Claims, 2 Drawing Sheets

CLASS J TIME DELAY FUSE

BACKGROUND OF THE INVENTION

This invention relates to fuses in general and in particular to an electric fuse that meets the minimum requirements of the Underwriter's Laboratories (UL) specification for Class J dimensioned fuses having time delay. A time-delay fuse is a type of fuse that has a built in delay that allows temporary and harmless inrush currents to pass without opening, but is designed to open on sustained overloads and short circuits.

The time-delay fuse can be a dual-element fuse and is used in circuits subjected to temporary inrush current transients, such as motor starting currents, to provide both high performance short-circuit current protection and time-delay overload current protection. Oversizing in order to prevent nuisance openings is not necessary. The dual-element fuse contains two distinctly separate types of elements which are series connected. Fuse links similar to those used in the single-element fuse perform the short-circuit protection function. The overload element provides protection against low-level overcurrents or overloads and will hold an overload which is five times greater than the ampere rating of the fuse for a minimum time of 10 seconds.

Underwriter's Laboratories has developed basic physical specifications and electrical performance requirements for fuses with voltage ratings of 600 volts or less. These are known as UL Standards. If a type of fuse meets the requirements of a standard, it can fall into that UL Class. Typical UL Classes are K, RK1, RK5, G, L, H, T, CC, and J. Class J fuses are rated to interrupt 200,000 amperes a.c. They are UL labeled as "Current Limiting", are rated for 600 volts a.c., and are not interchangeable with other classes. In order for a Class J fuse to be a time-delay fuse it is necessary that the fuse meet not only the voltage and current characteristics required, but the physical size limitations required by Underwriter's Laboratories. Thus the time-delay element and the short circuit element must be small and compact. It is necessary to have a fuse which is high capacity, fast acting, with time-delay, and yet will fit in the small package dictated by Underwriter's Laboratories for class J fuses.

SUMMARY OF THE INVENTION

The cylindrical form of the short-circuit element in the present invention provides an equal distribution of current densities to each of the parallel weak spot paths for the purpose of increasing the current capacity for 500% overload survivability. A large quantity of heat must be absorbed from the strip at 500% and the cylindrical form provides a large surface area to transfer this heat to the sand filler. This increased capacity combined with the large surface area heat transfer allows for a minimal cross-sectional weak spot area to exist for the purpose of reducing the short-circuit $I^2t$ and satisfy the UL requirements for maximum allowable $I^2t$ for a Class J time-delay fuse.

DETAILED DESCRIPTION OF THE INVENTION

Figure 1:
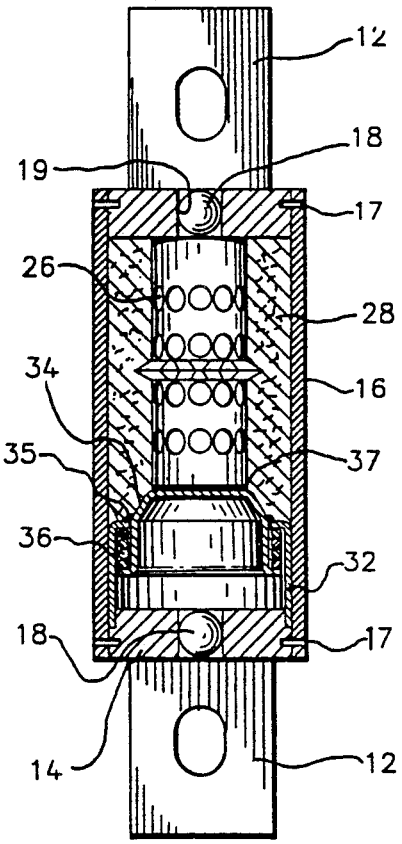
FIG. 1 shows a side view, cut away of a fuse according to the present invention.

Referring to FIG. 1 there is shown a fuse, designated in general by numeral 10, having a high interrupting capacity and incorporating a time-delay feature. The terminal 12 and end bell 14 connect fuse 10 to outside electrical connections. Internal components of the fuse 10 are surrounded by tube 16, which is attached to end bells 14 by pins 17.

Figure 2:
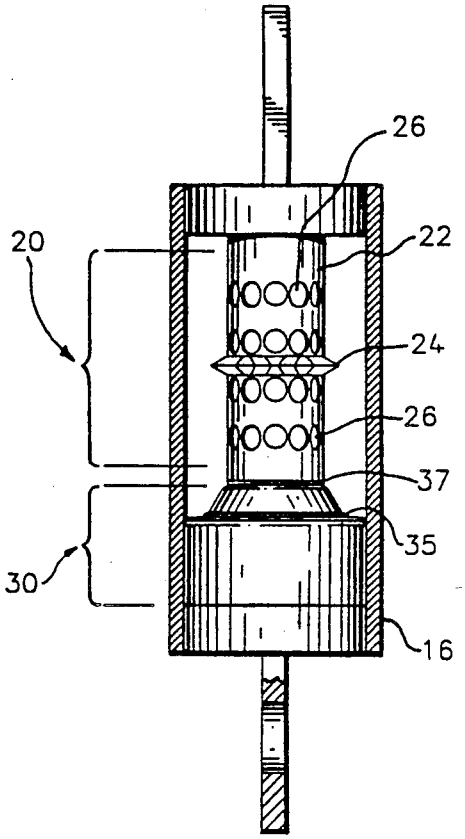
FIG. 2 shows a side view of a fuse according to the present invention, partially disassembled.
Figure 3:
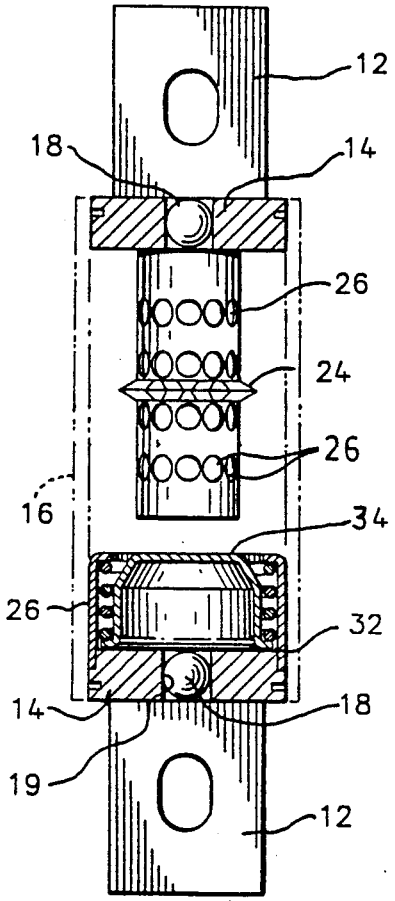
FIG. 3 shows a side view of a fuse according to the present invention rotated 90° from FIG. 2, and with the trigger mechanism activated and retracted.

The two main components of fuse 10, shown in FIG. 2, are the short circuit section 20, and the over load or trigger section 30. The short circuit section is comprised of a fuse element 22 formed in a cylindrical shape. Fuse element 22 shown in FIG. 3 has holes 26 which provide weak spots in fuse element 22. These holes 26 form a matrix of perforations providing a series of annular sections of reduced cross section along the major axis (length) of the short circuit section 26. Fuse element 22 incorporates a unique stress relief section 24. Thermal and mechanical stress relief section 24 is formed such that alternating "V" shaped sections project first inward and then outward, and so on around the circumference of element 22.

Figure 4:
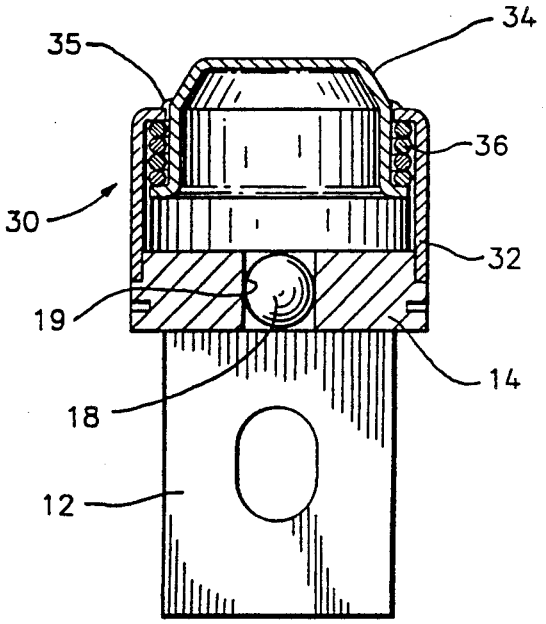
FIG. 4 shows a side view, in section, of the end bell and trigger mechanism.

Trigger section 30 is comprised, as shown in FIG. 4, of an absorber 32 attached by fuse alloy 35 to trigger 34. Spring 36 is held in compression by a lip on absorber 32 and complimentary lip on trigger 34. Absorber 32 is attached to end bell 14 which in turn is attached to terminal 12.

Referring again to FIG. 2 and FIG. 3, it is seen that element 22 is attached to trigger 34 by fusing alloy 37. In an overload condition, when current higher than the rated current, but not at the short circuit current, passes through the fuse, absorber 32 begins to heat up. At some point fusing alloy 35 and fusing alloy 37 will melt. At that point, trigger 34 is free to slide with respect to element 22, and is forced away from element 22 by spring 36, interrupting the current passing through fuse 10.

In a short circuit situation, the current passing through fuse 10 is high enough to burn through the weak spots in element 22 formed by holes 26 thus, interrupting current through fuse 10.

Filler 28 is added to fuse 10 through file holes 18. After addition of the filler, such as stone sand or quartz sand, plug 19 is inserted to close hole 18.

Figure 5:
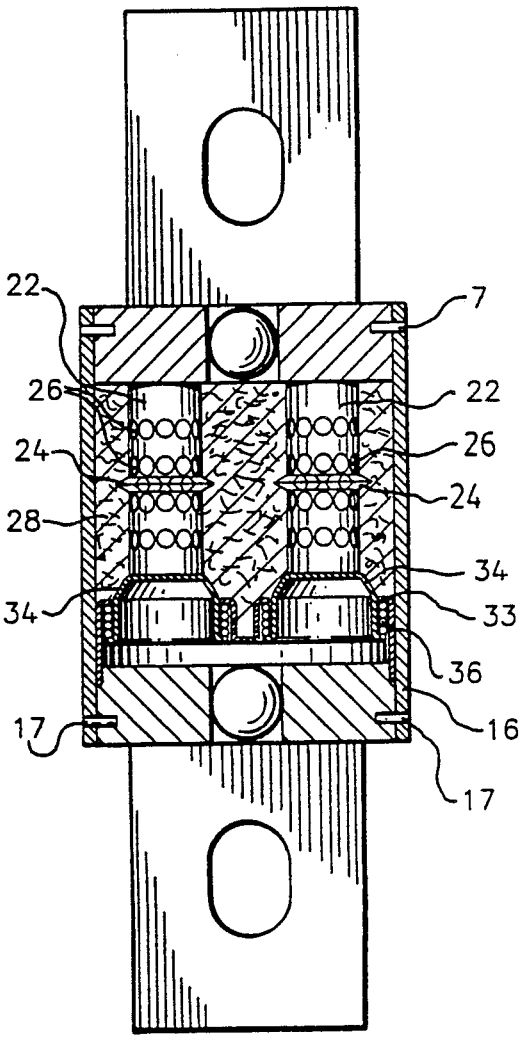
FIG. 5 shows another embodiment of the present invention with fuse elements mounted in parallel for higher capacity.

FIG. 5 shows another embodiment of the present invention which incorporates an absorber 33 capable of holding two trigger mechanisms 30. In this embodiment a higher capacity fuse can be manufactured still using trigger 34, and fusible elements 22, both of a standard size which has been used singularly in smaller, lower ampere rated fuses.

Figure 6:
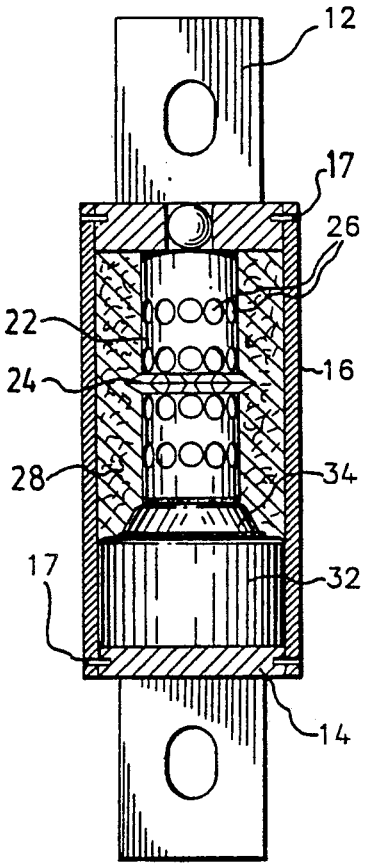
FIG. 6 shows a side view, cut away, of a fuse having a circular fusible element without a trigger section.

FIG. 6 shows a fuse wherein the short circuit element is circular. In this embodiment a trigger mechanism is not activated.

I claim:

1. A fuse comprising:
a first end bell assembly;
a second end bell assembly;
a hollow cylindrical fusible element having a plurality of perforations circumferentially formed therein to provide a plurality of parallel conductive paths,
said fusible element being electrically and mechanically connected to said first and said second end bell assemblies; and means for separating said fusible element from at least one of said end bell assemblies on an electrical current overload condition.

2. A fuse as in claim 1, said first end bell assembly comprising a first terminal, said second end bell assembly comprising a second terminal for said fusible elements.

3. A fuse as in claim 1, said fusible element comprising a stress relief section.

4. A time-delay having a first end bell assembly;
a trigger mechanism attached to said first end bell assembly;
a cylindrical fusible element connected to said trigger mechanism, said cylindrical fusible element having a plurality of parallel electrically and thermally conductive paths;
a second end bell assembly connected to said fusible element on an end opposite said trigger mechanism; and
a fuse tube enclosing said fusible element, and trigger mechanism, and attached to said first and said second end bell assemblies.

5. A fuse as in claim 4 wherein said fuse is filled with an arc quenching material for quenching an arc generated at either said fusible element or said trigger mechanism.

6. A fuse as in claim 4 wherein said cylindrical fusible element has circular openings in said element to provide weak spots.

7. A fuse as in claim 4 wherein said cylindrical fusible element has a stress relief section.

8. A fuse comprising first and second end bell assemblies, and a cylindrical fusible element having two ends;
said first end bell assembly comprising a first electrical terminal;
said second end bell assembly comprising a second electrical terminal;
said fusible element having a stress relief section intermediate said ends;
said fusible element being electrically and mechanically coupled to said first and second end bell assemblies.

9. A fuse as in claim 8 wherein said stress relief section comprises a plurality of angled segments, said segments projecting alternately radially inward and radially outward from said fusible element.

10. A fuse as in claim 8 wherein said fusible element further comprises a fusing section;
said fusing section having a predominant cross sectional area;
said stress relief section comprises a plurality of angled segments,
said stress relief section having a total cross sectional area of said stress relief segments located at positions along the length of said stress relief section which is substantially equal to said predominant cross sectional area of said fusing section.

11. An interrupting capacity time delay fuse comprising an electrically insulating cylindrical tube, a conductive first and second terminal respectively connected to a conductive first and second end bell and axially fastened to the open ends of said insulating cylindrical tube, and a fuse element coupled between said first and second end bells; said fuse element being comprised of a short circuit current element and a overload current trigger mechanism, said short circuit element being constructed of a fusible material formed into a cylinder and having a matrix of perforations forming a series of annular sections of reduced cross section along the major axis of the said short circuit element, said overload current trigger mechanism being connected to the said short circuit element by way of a fusible alloy which melts at a current higher than a rated current, said trigger mechanism being of a cylindrical form to match that of said short circuit element, said fuse element being of a cylindrical form such that each parallel path of said short circuit element created by said matrix of perforations is electrically and thermally equivalent to any other parallel path.

12. A high interrupting capacity time delay fuse in accordance with claim 11 wherein a first end bell assembly is comprised of said first terminal and said first end bell and a second end bell assembly is comprised of said second terminal and said second end bell, said first end bell assembly being continuously joined to the cylindrical end of said trigger mechanism such that a continuous current density exists on the cylindrical surface of said trigger mechanism such that any parallel path along the surface of said trigger mechanism is electrically and thermally equivalent to any other parallel path.

13. A high interrupting capacity time delay fuse in accordance with claim 11 wherein said cylindrical short circuit element is mechanically and thermally stress relieved between said annular sections of reduced cross section by "V" shaped sections alternately projecting first inward then outward continuing around the circumference, and said "V" shaped section being approximately perpendicular to the major axis of said cylindrical short circuit element such that axial compression or expansion of said short circuit element will tend to be absorbed by said "V" shaped sections to maintain proper alignment of said fuse element to said first and second end bell assembly.

* * * * *